US011417993B2

(12) United States Patent
Huang et al.

(10) Patent No.: US 11,417,993 B2
(45) Date of Patent: Aug. 16, 2022

(54) ADAPTER AND POWER TOOL SYSTEM

(71) Applicant: Globe (Jiangsu) Co., Ltd, Jiangsu (CN)

(72) Inventors: Lei Huang, Jiangsu (CN); Xinzhong Guo, Jiangsu (CN); An Yan, Jiangsu (CN)

(73) Assignee: Globe (Jiangsu) Co., Ltd, Changzhou (CN)

( * ) Notice: Subject to any disclaimer, the term of this patent is extended or adjusted under 35 U.S.C. 154(b) by 58 days.

(21) Appl. No.: 17/120,140

(22) Filed: Dec. 12, 2020

(65) Prior Publication Data

US 2021/0184410 A1 Jun. 17, 2021

(30) Foreign Application Priority Data

Dec. 12, 2019 (CN) ..... 201911271738.0

(51) Int. Cl.

| | |
|---|---|
| ***H01R 3/00*** | (2006.01) |
| ***H01R 33/94*** | (2006.01) |
| ***B25F 5/02*** | (2006.01) |
| ***H01R 13/627*** | (2006.01) |

(52) U.S. Cl.

CPC ..... *H01R 33/94* (2013.01); *B25F 5/02* (2013.01); *H01R 13/6275* (2013.01)

(58) Field of Classification Search

CPC ..... H01R 33/94; H01R 13/6275; B25F 5/02
USPC ..... 439/500
See application file for complete search history.

(56) References Cited

U.S. PATENT DOCUMENTS

| | | | | |
|---|---|---|---|---|
| 8,813,866 | B2 * | 8/2014 | Suzuki | H02J 7/00309 173/2 |
| 8,984,711 | B2 * | 3/2015 | Ota | H01M 50/20 15/405 |
| 9,160,125 | B2 * | 10/2015 | Ota | H01R 31/065 |
| 9,224,994 | B2 * | 12/2015 | Ota | H02J 1/10 |
| 9,337,677 | B2 * | 5/2016 | Suzuki | H01M 10/44 |
| 9,472,979 | B2 * | 10/2016 | Mergener | H02J 7/34 |
| 9,583,746 | B2 * | 2/2017 | Ota | H01M 50/209 |

(Continued)

FOREIGN PATENT DOCUMENTS

CN 109891621 A 6/2019

OTHER PUBLICATIONS

Extended European Search Report of counterpart European Patent Application No. 20213483.9 dated May 28, 2021.

*Primary Examiner* — Abdullah A Riyami
*Assistant Examiner* — Vladimir Imas

(57) ABSTRACT

An adapter for connecting a single voltage battery pack to a power tool, the single voltage battery pack configured to output only one voltage and provided with a single voltage battery interface, the power tool detachable coupled with a multi-voltage battery pack and provided with a power tool interface, the single voltage battery interface being not coupleable to the power tool interface, the adapter comprising a housing, an input interface disposed in the housing and provided for electrically and mechanically coupling with the single voltage battery interface of the single voltage battery pack, an output interface disposed in the housing and provided for electrically and mechanically coupling with the power tool interface of the power tool, the input interface electrically connected with the output interface, wherein the power tool can be powered by the single voltage battery pack through the adapter.

17 Claims, 5 Drawing Sheets

(56) References Cited

U.S. PATENT DOCUMENTS

| | | | | |
|---|---|---|---|---|
| 10,177,701 | B2 * | 1/2019 | White | H02J 7/0045 |
| 10,193,111 | B2 * | 1/2019 | Varipatis | H01M 50/543 |
| 10,236,819 | B2 * | 3/2019 | White | H02J 7/0024 |
| 10,250,178 | B2 * | 4/2019 | White | H02J 7/022 |
| 10,361,651 | B2 * | 7/2019 | White | H02P 27/08 |
| 10,559,789 | B2 * | 2/2020 | Ota | H01M 50/267 |
| 10,972,041 | B2 * | 4/2021 | White | H02J 7/0045 |
| 11,005,411 | B2 * | 5/2021 | White | H01M 50/572 |
| 11,005,412 | B2 * | 5/2021 | White | H01M 50/502 |
| 11,133,772 | B2 * | 9/2021 | White | H02P 25/14 |
| 11,152,886 | B2 * | 10/2021 | White | H02P 25/14 |
| 11,243,457 | B2 * | 2/2022 | Wei | F16M 11/04 |
| 2011/0147031 | A1 | 6/2011 | Matthias et al. | |
| 2013/0154584 | A1 | 6/2013 | Sakaue et al. | |
| 2017/0125754 | A1 | 5/2017 | Ota et al. | |
| 2018/0262150 | A1 * | 9/2018 | White | H01M 50/597 |
| 2018/0262151 | A1 * | 9/2018 | White | H01M 50/209 |
| 2018/0262152 | A1 * | 9/2018 | White | H01M 50/213 |
| 2018/0278196 | A1 * | 9/2018 | White | B25F 5/02 |
| 2019/0312242 | A1 | 10/2019 | Barton et al. | |
| 2020/0235694 | A1 * | 7/2020 | White | H01M 10/425 |
| 2020/0266751 | A1 * | 8/2020 | White | B25F 5/02 |
| 2020/0266752 | A1 * | 8/2020 | White | H01M 50/543 |
| 2020/0382045 | A1 * | 12/2020 | White | H01M 50/572 |
| 2020/0403553 | A1 * | 12/2020 | White | H02J 7/02 |
| 2021/0178569 | A1 * | 6/2021 | Huang | B25F 5/02 |

* cited by examiner

ADAPTER AND POWER TOOL SYSTEM

CROSS-REFERENCE TO RELATED INVENTIONS

This invention is a US invention which claims the priority of CN invention Serial No. CN201911271738.0, filed on Dec. 12, 2019, the disclosures of which are hereby incorporated by reference in their entirety.

TECHNICAL FIELD

The invention relates to an adapter and a power tool system with the adapter.

BACKGROUND ART

Generally, different power tools, such as hand-held blowers, hand-held electric drills, and the like, have different rated working voltages, therefore, manufacturers need to configure each power tool with a corresponding battery pack. When there are a various power tools, user must equip with a plurality of battery packs in various specifications. Therefore, the cost is increased, and a large space is occupied for storing the battery packs. Secondly, different power tools have different frequency of utilization. For example, handheld blowers are typically used more frequently in autumn and less frequently in other seasons. Moreover, different users have different use frequency for different power tools. For example, some users use the blowers frequently, and use the electric drill occasionally. Therefore, the battery pack matched with the electric drill is in an idle state for a long time, and resource waste is caused.

In order to solve the problems, technician design a multi-voltage battery pack with a multi-voltage battery interface and a power tool with a power tool interface for coupling with the multi-voltage battery interface. The multi-voltage battery interface has multiple coupling states so as to output different voltages through different coupling states, thereby the multi-voltage battery pack can be matched with multiple power tools. However, user still has a plurality of single voltage battery packs which are matched with old power tools. The single voltage battery pack has a single voltage battery interface which is matched with an old input interface of the old power tool and only can output a single voltage. The single voltage battery interface of the single voltage battery pack is not coupleable with the power tool interface of the new power tool, so that user's existing single voltage battery pack is idle, that causes waste of resources.

In view of the above, there is a need for an adapter to solve the above problems.

SUMMARY OF INVENTION

The object of the present invention is to provide an adapter, which can connect a power tool interface of a power tool with a signal voltage battery interface of a single voltage battery pack, so that the power tool being coupleable with the multi-voltage battery pack can match with the existing single voltage battery pack, and an application range of the single voltage battery pack is expanded to avoid waste of resources.

In order to achieve the above object, the present invention provides an adapter for connecting a single voltage battery pack to a power tool, the single voltage battery pack configured to output only one voltage and provided with a single voltage battery interface, the power tool detachable coupled with a multi-voltage battery pack and provided with a power tool interface, the single voltage battery interface being not coupleable to the power tool interface, the adapter comprises: a housing, an input interface disposed in the housing and provided for electrically and mechanically coupling with the single voltage battery interface of the single voltage battery pack, an output interface disposed in the housing and provided for electrically and mechanically coupling with the power tool interface of the power tool, the input interface electrically connected with the output interface, wherein the power tool can be powered by the single voltage battery pack through the adapter.

As a further improvement of the present invention, wherein the housing further forms an inserting portion on a side thereof away from the output interface for sliding inserting the single voltage battery interface of the single voltage battery pack.

As a further improvement of the present invention, wherein the housing comprises a top wall, a bottom wall opposite to the top wall, a front wall close to the output interface, a rear wall opposite to the front wall and two side walls located at two sides of the top wall, and the side wall is further provided with a sliding rail on a side thereof facing the inserting portion.

As a further improvement of the present invention, wherein the top wall, the bottom wall, the front wall, the rear wall and the side walls cooperatively surround and define a receiving cavity, an input terminal groove communicated with the receiving cavity is formed between the front wall and the bottom wall, and the input interface is mounted in the input terminal groove.

As a further improvement of the present invention, wherein the input interface comprises a first input terminal, a second input terminal, a third input terminal and a fourth input terminal, wherein the second input terminal and the third input terminal are positioned between the first input terminal and the fourth input terminal; the output interface comprises a first output terminal, a second output terminal, a third output terminal and a fourth output terminal, wherein the second output terminal and the third output terminal are positioned between the first output terminal and the fourth output terminal; the first input terminal is electrically connected to the first output terminal, and the fourth input terminal is electrically connected to the fourth output terminal.

As a further improvement of the present invention, wherein the adapter further comprises a housing and a latching mechanism mounted on the housing; the housing is provided with a receiving cavity; the latching mechanism comprises a latching arm and a pressing arm, the latching arm is partially received in the receiving cavity and partially protrudes outside of the receiving cavity, the pressing arm is linked with the latching arm and partially protrudes out of the receiving cavity, the latching arm enters into the receiving cavity when the pressing arm is pressed on.

As a further improvement of the present invention, wherein the latching mechanism also comprises an elastic element matched with the pressing arm or the latching arm; the elastic element is elastically deformed when the pressing arm is pressed; and the pressing arm or the latching arm resets under an action of the elastic element when the pressing arm is released.

As a further improvement of the present invention, wherein a guiding wall is obliquely arranged on a side of the latching arm facing the output interface.

In order to achieve the above object, the present invention also provides a power tool system comprises a power tool provided with a power tool interface for coupling with a multi-voltage battery pack, a single voltage battery pack configured to output only one voltage and provided with a single voltage battery interface, the single voltage battery interface being not coupleable with the power tool interface, an adapter, the adapter comprises a housing, an input interface disposed in the housing and provided for electrically and mechanically coupling with the single voltage battery interface of the single voltage battery pack, an output interface disposed in the housing and provided for electrically and mechanically coupling with the power tool interface of the power tool, the input interface electrically connected with the output interface, wherein the power tool can be powered by the single voltage battery pack through the adapter.

As a further improvement of the present invention, wherein the housing forms an inserting portion on a side thereof away from the output interface for sliding inserting the single voltage battery interface of the single voltage battery pack.

As a further improvement of the present invention, wherein the housing comprises a top wall, a bottom wall opposite to the top wall, a front wall close to the output interface, a rear wall opposite to the front wall and two side walls located at two sides of the top wall, and the side wall is further provided with a sliding rail on a side thereof facing the inserting portion.

As a further improvement of the present invention, wherein the top wall, the bottom wall, the front wall, the rear wall and the side walls cooperatively surround and define a receiving cavity, an input terminal groove communicated with the receiving cavity is formed between the front wall and the bottom wall, and the input interface is mounted in the input terminal groove.

As a further improvement of the present invention, wherein the input interface comprises a first input terminal, a second input terminal, a third input terminal and a fourth input terminal, wherein the second input terminal and the third input terminal are positioned between the first input terminal and the fourth input terminal; the output interface comprises a first output terminal, a second output terminal, a third output terminal and a fourth output terminal, wherein the second output terminal and the third output terminal are positioned between the first output terminal and the fourth output terminal; the first input terminal is electrically connected to the first output terminal, and the fourth input terminal is electrically connected to the fourth output terminal.

As a further improvement of the present invention, wherein the adapter further comprises a housing and a latching mechanism mounted on the housing; the housing is provided with a receiving cavity; the latching mechanism comprises a latching arm and a pressing arm, the latching arm is partially received in the receiving cavity and partially protrudes outside of the receiving cavity, the pressing arm is linked with the latching arm and partially protrudes out of the receiving cavity, the latching arm enters into the receiving cavity when the pressing arm is pressed on.

As a further improvement of the present invention, wherein the latching mechanism also comprises an elastic element matched with the pressing arm or the latching arm; the elastic element is elastically deformed when the pressing arm is pressed; and the pressing arm or the latching arm resets under an action of the elastic element when the pressing arm is released.

As a further improvement of the present invention, wherein a guiding wall is obliquely arranged on a side of the latching arm facing the output interface.

In order to achieve the above object, the present invention also provides a power tool system comprising a multi-voltage battery pack configured to output at least two different voltages, a power tool provided with a power tool interface for electrically and mechanically coupling with the multi-voltage battery pack, a single voltage battery pack configured to output only one voltage and provided with a single voltage battery interface, the single voltage battery interface being not coupleable with the power tool interface, an adapter, the adapter comprises a housing, an input interface disposed in the housing and provided for electrically and mechanically coupling with the single voltage battery interface of the single voltage battery pack, an output interface disposed in the housing and provided for electrically and mechanically coupling with the power tool interface of the power tool, the input interface electrically connected with the output interface, wherein the power tool can be powered by the single voltage battery pack through the adapter.

The beneficial effect of the present invention is that: the adapter of the present invention can connect a power tool interface of a power tool being coupleable with a multi-voltage battery pack with a single voltage battery interface of a single voltage battery pack, so that the power tool can use the single voltage battery pack, an application range of the single voltage battery pack is expanded to avoid waste of resources.

DESCRIPTION OF EMBODIMENT

In order to make the objectives, technical solutions, and advantages of the present invention clearer, the following describes the present invention in detail with reference to accompanying drawings and specific embodiment.

Different power tools, such as hand-held blowers, hand-held electric drills, and the like, have different rated working voltages, therefore, manufacturers need to configure each power tool with a single voltage battery pack. Such single voltage battery pack can only output one voltage, thereby only being able to match with a single type of power tools whose rated working voltage is same as the output voltage of the single voltage battery pack but not power tools having different rated working voltages. So technicians design a battery pack with a multi-voltage output interface and a new power tool with a new interface for coupling with the multi-voltage output interface. The multi-voltage output interface has at least two coupling states so as to output different voltages through different coupling states, thereby the multi-voltage battery pack can match with various power tools having corresponding rated working voltages. However, an output interface of single voltage battery pack is incompatible with the interface of the power tool which can mate with multi-voltage battery pack, so that user's existing single voltage battery pack is idle, that causes waste of resources.

Figure 1:
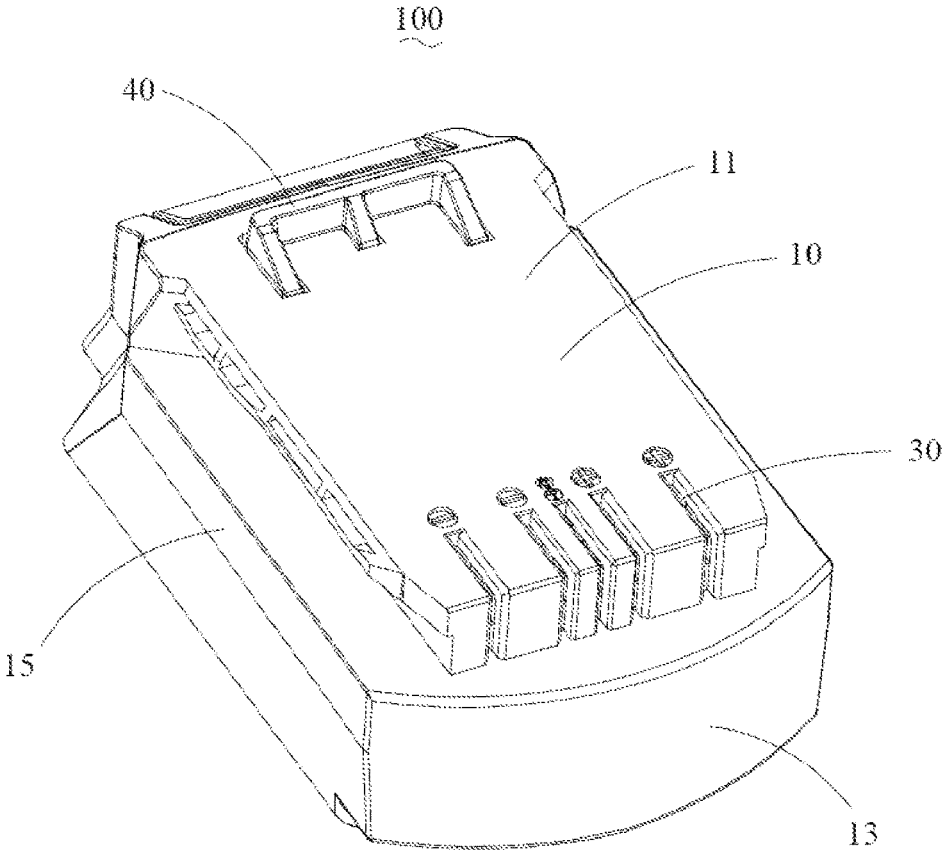
FIG. 1 is a perspective view of an adapter according an embodiment of the present invention.
Figure 2:
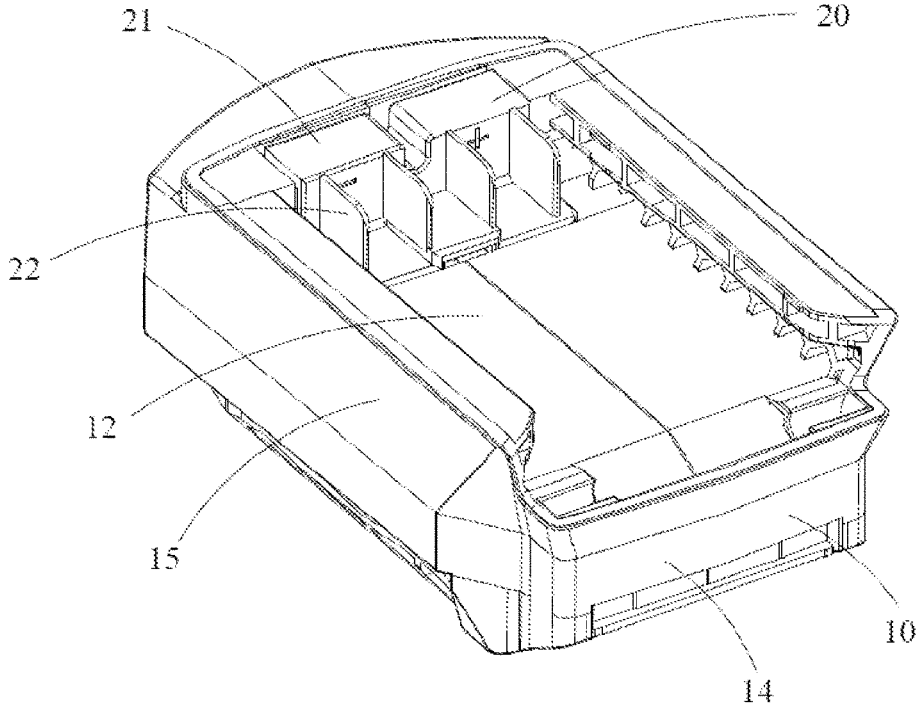
FIG. 2 is another perspective view of the adapter shown in FIG. 1 from another angle.

Referring to FIG. 1 and FIG. 2, the present invention discloses an adapter 100 for solving the problem that the output interface of the single voltage battery pack is incompatible with the power tool interface of the power tool that can be coupled with multi-voltage battery pack, so as to prevent user's single voltage battery pack from being in an idle state, thereby improving the utilization rate of the single voltage battery pack. The adapter 100 includes a housing 10, an input interface 20, an output interface 30 electrically connected to the input interface 20 and a latching mechanism 40.

Figure 3:
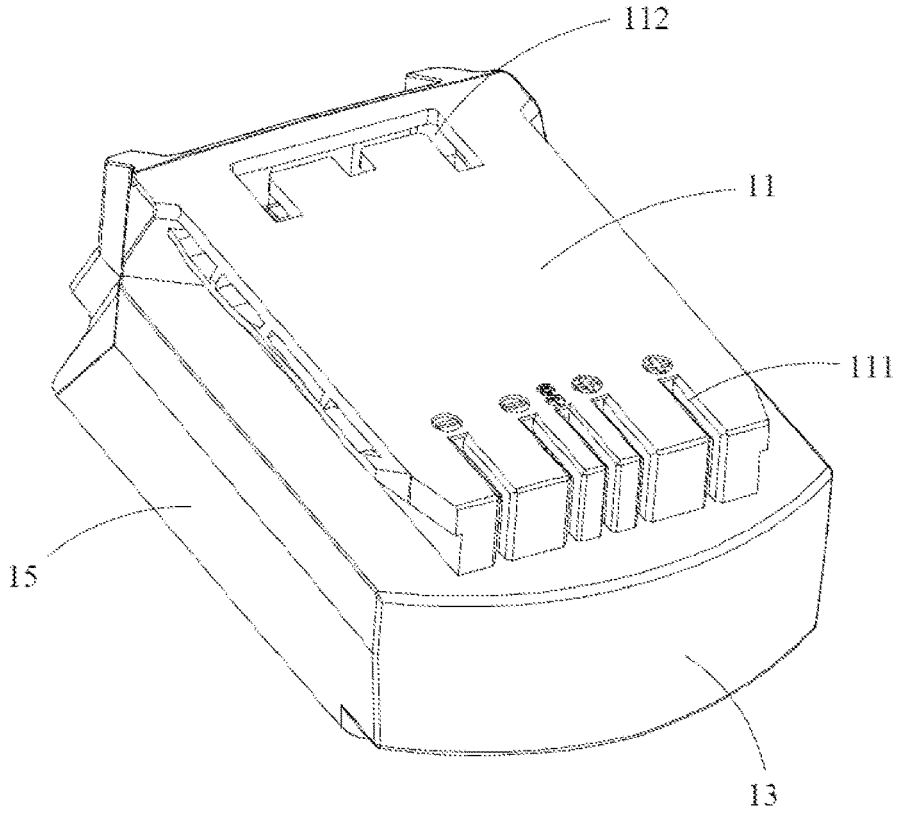
FIG. 3 is a perspective view of a housing of the adaptor shown in FIG. 1.
Figure 4:
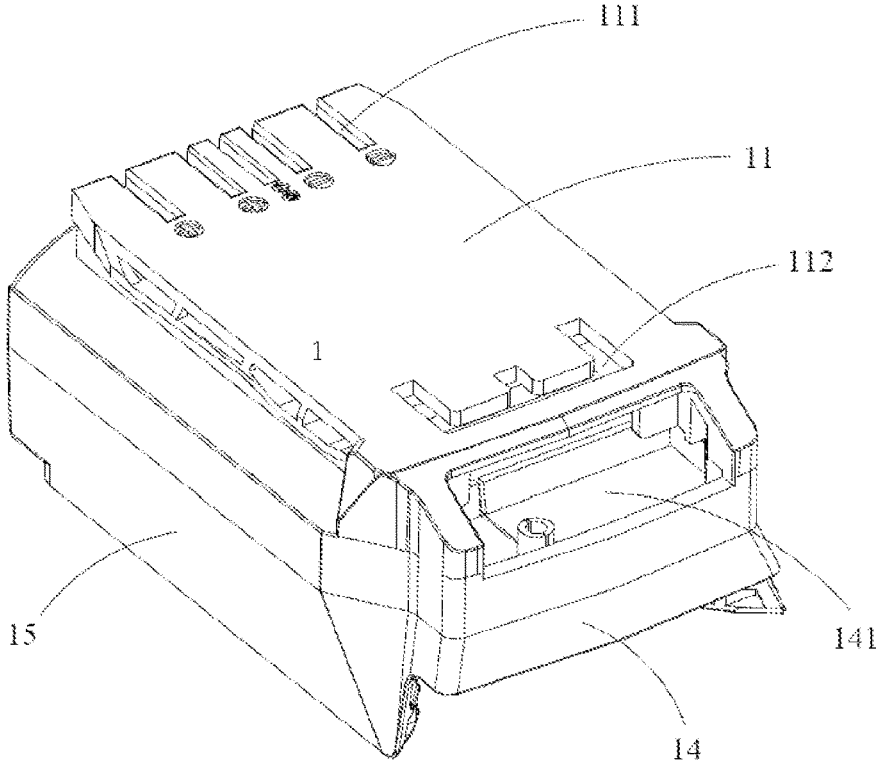
FIG. 4 is another perspective view of the housing shown in FIG. 3 from another angle.
Figure 5:
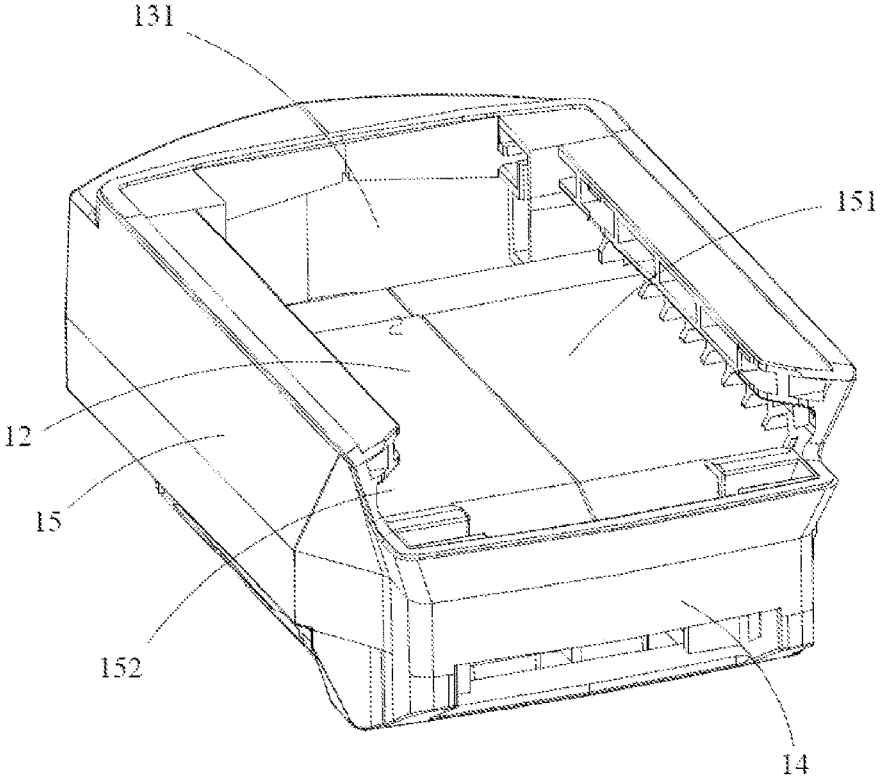
FIG. 5 is another perspective view of the housing shown in FIG. 3 from another angle.

Referring to FIGS. 3-5, the housing 10 includes a top wall 11, a bottom wall 12 opposite to the top wall 11, a front wall 13 near the output interface 30, a rear wall 14 near the latching mechanism 40, and two side walls 15 at two sides of the top wall 11. The top wall 11, the bottom wall 12, the front wall 13, the rear wall 14, and the side walls 15 together define a receiving cavity (not shown) for receiving the input interface 20, the output interface 30 and the latching mechanism 40.

A terminal receiving groove 111 is formed at an end of the top wall 11 close to the front wall 13, and communicates with the receiving cavity. A retaining groove 112 communicating with the receiving cavity is provided on an end of the top wall 11 close to the rear wall 14. An input terminal groove 131 communicating with the receiving cavity is arranged between the front wall 13 and the bottom wall 12. The rear wall 14 is provided with a pressing groove 141 communicating with the receiving cavity. The bottom wall 12 and the side wall 15 jointly form an inserting portion 151 for sliding inserting the output interface provided on the single voltage battery pack. In this embodiment, the inserting portion 151 is an open receiving groove. The side wall 15 is further provided with a sliding rail 152 on each side thereof facing the inserting portion 151 to guide the single voltage battery pack to slide into. In this embodiment, the sliding rail 152 is a groove. However, it is understood that the sliding rail 152 may also be a protrusion, and present invention is not limited to the specific structure of the sliding rail 152.

Figure 6:
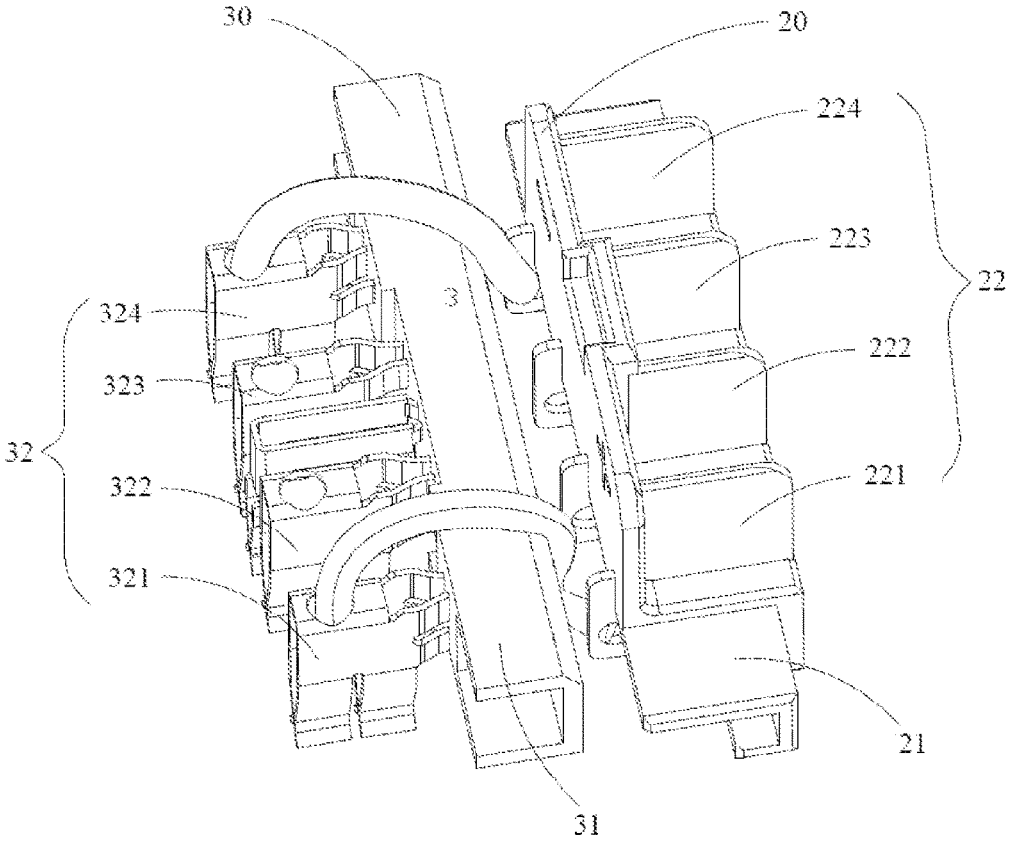
FIG. 6 is a view showing the connection between an input interface of the adaptor and an output interface of the adaptor.
Figure 8:
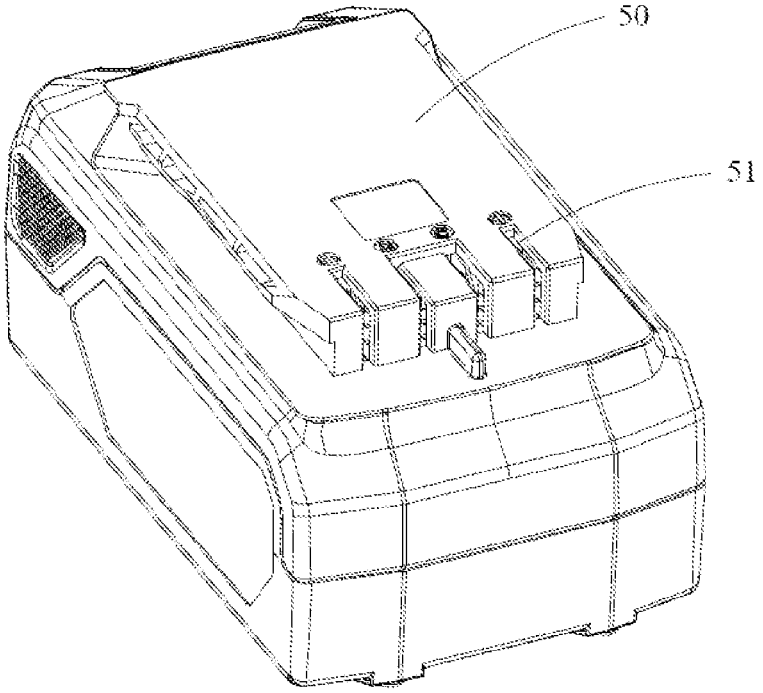
FIG. 8 is a perspective view of a single voltage battery pack.

The input interface 20 is coupled to the output interface provided on the single voltage battery pack to obtain a single output voltage of the single voltage battery pack, and the single voltage battery interface is not matched with the power tool interface provided on the power tool. Referring to FIG. 2 and FIG. 5, the input interface 20 is installed in the input terminal groove 131 and is used to match with the single voltage battery pack 50 shown in FIG. 8. The single voltage battery pack 50 is provided with the single voltage battery interface 51. The single voltage battery interface 51 has only one coupling state, and thus can only output a single voltage. The single voltage battery pack has a positive output terminal, a negative output terminal. Referring to FIG. 6, the input interface 20 includes a base 21 and an input terminal group 22 mounted on the base 21. The input terminal group 22 includes a first input terminal 221, a second input terminal 222, a third input terminal 223, and a fourth input terminal 224, wherein the second input terminal 222 and the third input terminal 223 are located between the first input terminal 221 and the fourth input terminal 224. The first input terminal 221 can connect with the positive output terminal of the single voltage battery pack, the fourth input terminal 224 can connect with the negative output terminal of the single voltage battery pack.

The output interface 30 is electrically connected to the input interface 20 to obtain power from the single voltage battery. The output interface 30 is coupled to the power tool interface provided on the power tool to output voltage to the power tool. The power tool interface is matched with a multi-voltage battery interface disposed on a multi-voltage battery pack, and the multi-voltage battery interface has at least two coupling states so as to output different voltages in different coupling states. It can be understood that the specific structure of the multi-voltage battery interface disposed on the multi-voltage battery pack and the power tool interface matched with the multi-voltage battery interface have various structures, for example, Chinese patent application No. 201780067581.2 discloses various multi-voltage battery interfaces and power tool interfaces matched with the multi-voltage battery interfaces. The present invention is intended to connect the single voltage battery interface provided on the single voltage battery pack with power tool interface provided on the power tool that can coupled with multi-voltage battery pack, therefore, the output interface 30 only needs to be matched with the power tool interface of the power tool. As for the specific structure of the output interface 30, the present invention is not particularly limited.

Figure 9:
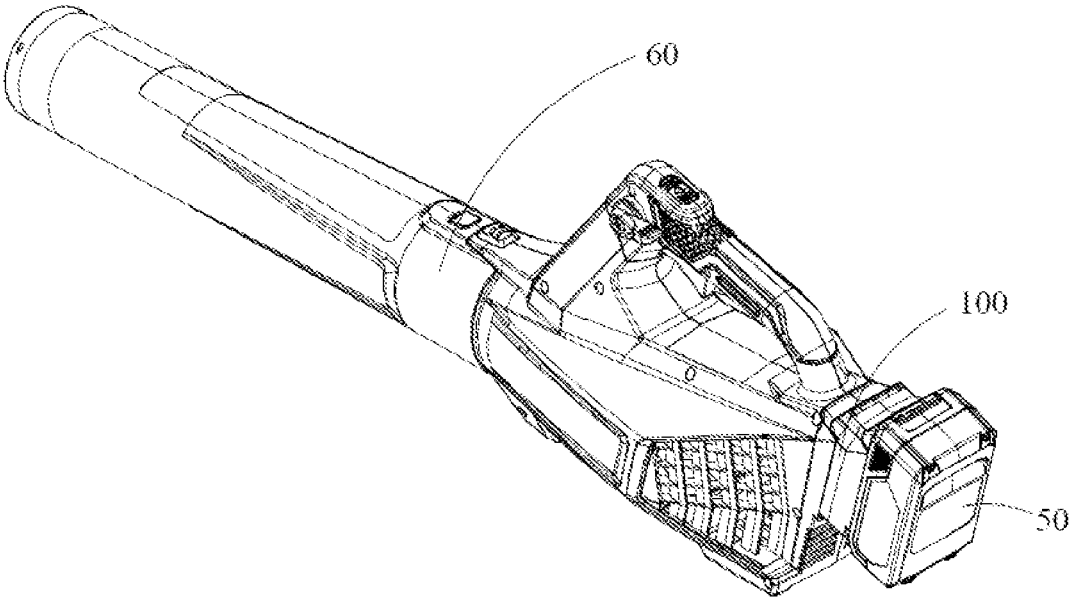
FIG. 9 is a perspective view showing a power tool, the adapter, and the single voltage battery pack are coupled with each other.

The output interface 30 in FIG. 6 is one of many embodiments of the present invention for coupling with the power tool 60 in FIG. 9. The power tool 60 is provided with the power tool interface (not shown) for matching with a multi-voltage battery interface provided on the multi-voltage battery pack, the multi-voltage battery interface has a plurality of coupling states to output different voltages in different coupling states.

The output interface 30 includes a base portion 31 and an output terminal group 32 mounted on the base portion 31 and located in the terminal receiving groove 111. The output terminal group 32 includes a first output terminal 321, a second output terminal 322, a third output terminal 333, and a fourth output terminal 334, wherein the second output terminal 332 and the third output terminal 333 are located between the first output terminal 331 and the fourth output terminal 334. The first input terminal 221 of the input interface 20 is electrically connected to the first output terminal 321, and the fourth input terminal 224 of the input interface 20 is electrically connected to the fourth output terminal 324, so that the output interface 30 obtains an output voltage from the single voltage battery pack. Furthermore, the first output terminal 321 connect with the positive input terminal of the power tool interface of the power tool, the fourth output terminal 324 connect with the negative input terminal of the power tool interface of the power tool.

Figure 7:
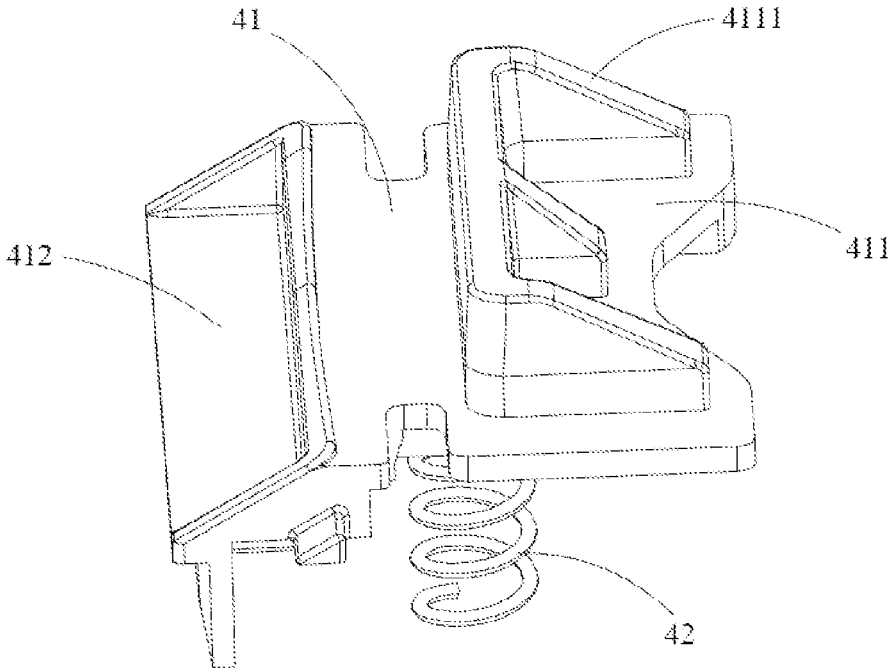
FIG. 7 is a perspective view of a latching mechanism of the adaptor.

Referring to FIG. 7, the latching mechanism 40 includes a main body 41 and an elastic element 42 engaged with the main body 41. The main body 41 has a latching arm 411 at an end thereof and a pressing arm 412 at the other end thereof. The latching arm 411 is partially received in the receiving cavity and partially protrudes outside of the receiving cavity from a retaining groove 112. A guiding wall 4111 is obliquely arranged on a side of the latching arm 411 facing the output interface 30. The pressing arm 412 at least partially protrudes out of the receiving cavity by the pressing groove 141. One end of the elastic element 42 is fixedly mounted on the main body 41, and the other end of the elastic element 42 is mounted on the housing 10. When the pressing arm 412 is pressed, the latching arm 411 is driven by the pressing arm 412 to move and enter the receiving cavity from the retaining groove 112, and at this time, the elastic element 42 is in an elastic deformation state. When the pressing arm 412 is released, the pressing arm 412 or the latching arm 411 is reset under the action of the elastic element 42. In the present embodiment, the elastic element 42 is a spring, but in other embodiments, the elastic element 42 may also be an elastic plastic, an elastic sheet, or the like.

Referring to FIG. 1, FIG. 2, FIG. 7 and FIG. 9, when using the adaptor 100 of the present invention, firstly, press the pressing arm 412 and bring the latching arm 411 entering the receiving cavity, then match the power tool interface of the power tool 60 with the output interface 30 of the adaptor 100, then release the pressing arm 412, the latching arm 411 resets under the action of the elastic element 42 and locks with a retaining structure disposed on the power tool 60 to fix the adaptor 100 on the power tool 60. After that, match the single voltage battery interface of the single voltage battery pack 50 with the input interface 20 of the adaptor 100. In fact, when the adapter 100 sliding into the power tool 60, the guiding wall 4111 cooperates with a corresponding housing on the power tool 60 and slowly enter the receiving cavity under the action of the corresponding housing, that is the user need not press the pressing arm 412 when sliding the adapter 100 into the power tool 60.

The invention also discloses a power tool system, which comprises a power tool provided with a power tool interface, a single voltage battery pack provided with a single voltage battery interface and an adapter 100. The power tool interface of the power tool is used for matching with a multi-voltage battery interface, which is disposed on a multi-voltage battery pack and has at least two coupling states so as to output at least two different voltages in different coupling states. The single voltage battery interface disposed on the single voltage battery pack is incompatible with the power tool interface of the power tool that is coupleable with multi-voltage battery pack.

Compared with the prior art, the adapter 100 of the present invention can electrically connect the single voltage battery interface of the single voltage battery pack with the power tool interface of the power tool that is matched with the multi-voltage battery pack, so that the power tool that can be matched with the multi-voltage battery pack can be powered by the single voltage battery pack to improve the utilization rate of the old single voltage battery pack.

Although the present invention has been described in detail with reference to the preferred embodiments, it will be understood by those skilled in the art that various changes may be made and equivalents may be substituted for elements thereof without departing from the spirit and scope of the present invention.

What is claimed is:

1. An adapter for connecting a single voltage battery pack to a power tool, the single voltage battery pack configured to output only one voltage and provided with a single voltage battery interface, the power tool detachable coupled with a multi-voltage battery pack and provided with a power tool interface, the single voltage battery interface being not coupleable to the power tool interface, the adapter comprising:

a housing;

an input interface disposed in the housing and provided for electrically and mechanically coupling with the single voltage battery interface of the single voltage battery pack;

an output interface disposed in the housing and provided for electrically and mechanically coupling with the power tool interface of the power tool; and the input interface electrically connected with the output interface;

wherein the power tool can be powered by the single voltage battery pack when the single voltage battery interface of the single voltage battery pack is coupled with the input interface of the adapter and the power tool interface of the power tool is coupled with the output interface of the adapter.

2. The adapter according to claim 1, wherein the housing forms an inserting portion on a side thereof away from the output interface for sliding inserting the single voltage battery interface of the single voltage battery pack.

3. The adapter according to claim 2, wherein the housing comprises a top wall, a bottom wall opposite to the top wall, a front wall close to the output interface, a rear wall opposite to the front wall and two side walls located at two sides of the top wall, and the side wall is further provided with a sliding rail on a side thereof facing the inserting portion.

4. The adapter according to claim 3, wherein the top wall, the bottom wall, the front wall, the rear wall and the side walls cooperatively surround and define a receiving cavity, an input terminal groove communicated with the receiving cavity is formed between the front wall and the bottom wall, and the input interface is mounted in the input terminal groove.

5. The adapter according to claim 1, wherein the input interface comprises a first input terminal, a second input terminal, a third input terminal and a fourth input terminal, wherein the second input terminal and the third input terminal are positioned between the first input terminal and the fourth input terminal; the output interface comprises a first output terminal, a second output terminal, a third output terminal and a fourth output terminal, wherein the second output terminal and the third output terminal are positioned between the first output terminal and the fourth output terminal; the first input terminal is electrically connected to the first output terminal, and the fourth input terminal is electrically connected to the fourth output terminal.

6. The adapter according to claim 1, wherein the adapter further comprises a latching mechanism mounted on the housing; the housing is provided with a receiving cavity; the latching mechanism comprises a latching arm and a pressing arm, the latching arm is partially received in the receiving cavity and partially protrudes outside of the receiving cavity, the pressing arm is linked with the latching arm and partially protrudes out of the receiving cavity, the latching arm enters into the receiving cavity when the pressing arm is pressed on.

7. The adapter according to claim 6, wherein the latching mechanism also comprises an elastic element matched with the pressing arm or the latching arm; the elastic element is elastically deformed when the pressing arm is pressed; and the pressing arm or the latching arm resets under an action of the elastic element when the pressing arm is released.

8. The adapter according to claim 6, wherein a guiding wall is obliquely arranged on a side of the latching arm facing the output interface.

9. A power tool system, comprising:

a power tool provided with a power tool interface for coupling with a multi-voltage battery pack;

a single voltage battery pack configured to output only one voltage and provided with a single voltage battery interface, the single voltage battery interface being not coupleable with the power tool interface; and an adapter, the adapter comprising:

a housing;

an input interface disposed in the housing and provided for electrically and mechanically coupling with the single voltage battery interface of the single voltage battery pack;

an output interface disposed in the housing and provided for electrically and mechanically coupling with the power tool interface of the power tool; and the input interface electrically connected with the output interface;

wherein the power tool can be powered by the single voltage battery pack when the single voltage battery interface of the single voltage battery pack is coupled with the input interface of the adapter and the power tool interface of the power tool is coupled with the output interface of the adapter.

10. The power tool system according to claim 9, wherein the housing forms an inserting portion on a side thereof away from the output interface for sliding inserting the single voltage battery interface of the single voltage battery pack.

11. The power tool system according to claim 10, wherein the housing comprises a top wall, a bottom wall opposite to the top wall, a front wall close to the output interface, a rear wall opposite to the front wall and two side walls located at two sides of the top wall, and the side wall is further provided with a sliding rail on a side thereof facing the inserting portion.

12. The power tool system according to claim 11, wherein the top wall, the bottom wall, the front wall, the rear wall and the side walls cooperatively surround and define a receiving cavity, an input terminal groove communicated with the receiving cavity is formed between the front wall and the bottom wall, and the input interface is mounted in the input terminal groove.

13. The power tool system according to claim 9, wherein the input interface comprises a first input terminal, a second input terminal, a third input terminal and a fourth input terminal, wherein the second input terminal and the third input terminal are positioned between the first input terminal and the fourth input terminal; the output interface comprises a first output terminal, a second output terminal, a third output terminal and a fourth output terminal, wherein the second output terminal and the third output terminal are positioned between the first output terminal and the fourth output terminal; the first input terminal is electrically connected to the first output terminal, and the fourth input terminal is electrically connected to the fourth output terminal.

14. The power tool system according to claim 9, wherein the adapter further comprises a housing and a latching mechanism mounted on the housing; the housing is provided with a receiving cavity; the latching mechanism comprises a latching arm and a pressing arm, the latching arm is partially received in the receiving cavity and partially protrudes outside of the receiving cavity, the pressing arm is linked with the latching arm and partially protrudes out of the receiving cavity, the latching arm enters into the receiving cavity when the pressing arm is pressed on.

15. The power tool system according to claim 14, wherein the latching mechanism also comprises an elastic element matched with the pressing arm or the latching arm; the elastic element is elastically deformed when the pressing arm is pressed; and the pressing arm or the latching arm resets under an action of the elastic element when the pressing arm is released.

16. The power tool system according to claim 14, wherein a guiding wall is obliquely arranged on a side of the latching arm facing the output interface.

17. A power tool system, comprising:

a multi-voltage battery pack configured to output at least two different voltages;

a power tool provided with a power tool interface for electrically and mechanically coupling with the multi-voltage battery pack;

a single voltage battery pack configured to output only one voltage and provided with a single voltage battery interface, the single voltage battery interface being not coupleable with the power tool interface; and an adapter, the adapter comprising:

a housing;

an input interface disposed in the housing and provided for electrically and mechanically coupling with the single voltage battery interface of the single voltage battery pack;

an output interface disposed in the housing and provided for electrically and mechanically coupling with the power tool interface of the power tool; and the input interface electrically connected with the output interface;

wherein the power tool can be powered by the single voltage battery pack when the single voltage battery interface of the single voltage battery pack is coupled with the input interface of the adapter and the power tool interface of the power tool is coupled with the output interface of the adapter.

* * * * *